US007776185B2

(12) United States Patent
Elenz

(10) Patent No.: US 7,776,185 B2
(45) Date of Patent: Aug. 17, 2010

(54) PAPER MACHINE COMPRISING A SINGLE NIP PRESS

(75) Inventor: Thomas Elenz, Steinheim (DE)

(73) Assignee: Voith Patent GmbH, Heidenheim (DE)

( * ) Notice: Subject to any disclaimer, the term of this patent is extended or adjusted under 35 U.S.C. 154(b) by 633 days.

(21) Appl. No.: 11/660,574

(22) PCT Filed: Aug. 4, 2005

(86) PCT No.: PCT/EP2005/053834

§ 371 (c)(1),
(2), (4) Date: Feb. 16, 2007

(87) PCT Pub. No.: WO2006/018388

PCT Pub. Date: Feb. 23, 2006

(65) Prior Publication Data

US 2007/0251661 A1 Nov. 1, 2007

(30) Foreign Application Priority Data

Aug. 16, 2004 (DE) ..... 10 2004 039 785
Nov. 22, 2004 (DE) ..... 10 2004 056 320

(51) Int. Cl.
*D21F 3/00* (2006.01)

(52) U.S. Cl. ..... 162/358.3; 162/206

(58) Field of Classification Search ..... 162/358.3, 162/206

See application file for complete search history.

(56) References Cited

U.S. PATENT DOCUMENTS

| | | | |
|---|---|---|---|
| 5,147,508 | A | 9/1992 | Sweet et al. |
| 5,933,980 | A | 8/1999 | Deshpande et al. |
| 6,103,062 | A | 8/2000 | Ampulski et al. |
| 6,428,655 | B1 | 8/2002 | Kerttula |
| 6,638,395 | B1 | 10/2003 | Elenz |
| 2001/0045023 | A1 | 11/2001 | Kahl et al. |
| 2004/0050517 | A1 | 3/2004 | Juppi et al. |

FOREIGN PATENT DOCUMENTS

| | | | |
|---|---|---|---|
| DE | 10132652 | A1 | 1/2003 |
| WO | WO 01/00925 | A | 1/2001 |

*Primary Examiner*—Mark Halpern
(74) *Attorney, Agent, or Firm*—Bachman & LaPointe, P C.

(57) ABSTRACT

The invention relates to a machine for producing and/or further processing a fibrous web, said machine comprising a press part and a drying part. The press part comprises only one press nip, and the first or second drying group of the dry part comprises an air-flow drying unit.

22 Claims, 1 Drawing Sheet

PAPER MACHINE COMPRISING A SINGLE NIP PRESS

This application is a 371/EP05/53834 filed on 4 Aug. 2005.

BACKGROUND OF THE INVENTION

This invention relates to a machine for producing and/or further processing a fibrous web, particularly one of paper according to the preamble of the patent claim 1 together with a process for producing fibrous webs.

Fibrous materials with and without a content of mechanical wood pulp and, in particular, papers of such a nature are increasingly produced at rising web running speeds. This results in an increase in the level of stress experienced by the moist fibrous web.

Furthermore, to an increasing extent in such production the content of the added filler materials is being increased with the result that the strength of the moist fibrous web is correspondingly reduced.

The described conflicting tendencies increasingly lead to web breaks during the production process and, consequently, to "runability" problems.

SUMMARY OF THE INVENTION

The object is to propose a machine for the production and/or further processing of fibrous webs with an elevated content of filler materials at increased web running speeds, which is an improved machine in the context of "runability" and one which furthermore is economic to run and of a space-saving design. It is equally the object of the invention to propose improved processes for the production of fibrous webs with an elevated content of filler materials at increased web running speeds.

The object is achieved by a machine together with a process as disclosed herein.

Advantageous further developments and configurations of the invention are given in the dependent claims.

The machine according to the invention for the production and/or further processing of a fibrous web exhibits a pressing section and a drying section, where the pressing section comprises solely one single press-nip and where at least the first and/or second drying group of the drying section comprises an air-flow drying unit.

It has been shown that by using a pressing section with only a single press-nip in combination with a drying section which comprises an air-flow drying unit in the first or second drying group, a machine for the production of fibrous webs is created which has improved runability properties than known machines according to the prior art and which, furthermore, can be economically produced and is of a compact design.

As a result of using one pressing section with only a single press-nip it is not necessary that the fibrous web be transferred in the pressing section from one element of machine clothing to another such element. In this way the danger of web breaks in the pressing section is clearly reduced. An air-flow drying unit has a significantly higher drying capacity than conventional heated drying cylinders. By using an air-flow drying unit at least in the first and/or second drying group of the drying section, the dry-weight content of the fibrous web will already be increased at the commencement of the drying section in such a manner that that the web is sufficiently strong and resistant to a web break, whereby the runability is equally clearly increased.

The pressing section with only a single press-nip is clearly more compact than conventional pressing sections with several press-nips. The drying section with an air-flow drying unit at least in the first and/or second drying group can be designed to be more compact for the same drying performance than conventional drying groups with heated drying cylinders. Consequently, the machine according to the invention is clearly of a more compact design than known machines for the production and/or further processing of fibrous webs.

In addition, since the machine according to the invention requires fewer individual components, it is more economical to build and to operate.

Preferably, in the forming part the fibrous web is de-watered to a dry-weight content of at least 18% with a special preference for a dry-weight content of at least 20%.

The machine according to the invention is preferably used for the production of fibrous webs with weights per unit area in the range between 35 g/m$^2$ and 120 g/m$^2$ and filler material contents of between 10% and 40% at web running speeds of up to 2400 m/min and more.

The drying capacity can clearly be increased if the first and the second drying group of the drying section comprises an air-flow drying unit. By this means, the runability is further increased. Furthermore the spatial extent of the drying section can be clearly reduced, so that the machine for the production and/or further processing of a fibrous web becomes more compact.

Preferably, at least one air-flow drying unit of the according to the invention operates according to the principle of through-flow air drying also known as TAD-drying.

According to another preferred embodiment of the invention, at least one air-flow drying unit operates according to the principle of impact-flow drying also known as impingement-drying.

In order to increase the drying capacity in the air-flow drying unit it, is logical if the fibrous web to be dried is exposed directly to the flow of air. Consequently, a preferred configuration of the invention provides that the fibrous web is not covered with an element of machine clothing on the side facing the flow of air.

If the first and the second drying group comprises an air-flow drying unit, the fibrous web is preferably led through the two air-flow drying units in such a manner that in one air-flow drying unit one side of the fibrous web faces the flow of air and in the other following air-flow drying unit the other side of the fibrous web faces the flow of air. By the symmetrical treatment of the fibrous web in the drying section symmetrical development of the fibrous web is assisted, i.e. the fibrous web is provided with similar properties on both sides.

A further advantageous embodiment of the invention provides that the machine comprises several pairs of air-flow drying units, where in each case in the first air-flow drying unit of the pair one side of the fibrous web faces the flow of air and where in the following second air-flow drying unit of the pair the other side of the fibrous web faces the flow of air.

The multiple symmetrical treatment of the fibrous web—each pair treats the fibrous web symmetrically—assists on the one hand in providing a symmetrical development of the fibrous web, i.e. with similar properties of the fibrous web on both sides. On the other hand, it is possible for the same drying capacity to design the drying section in a clearly more compact form than is possible with conventional drying groups with heated drying cylinders. Generally speaking, for a given machine length and a given dry-weight content the use of pairs of the abovementioned air-flow drying units means that an increase in speed of 2% or more can be assumed compared with the use of conventional heated drying cylinders.

In a conventional drying group, the fibrous web to be dried wraps round a part of each heated drying cylinder. Trials have shown that satisfactory drying capacities can be obtained in the air-flow drying unit if the air-flow drying unit has a drying cylinder with a diameter of 3 meters or more, preferably of 4 meters or more, i.e. the relevant drying group is formed of only one such drying cylinder.

To increase the runability by means of improved web guidance round the drying cylinder provision is made for the drying cylinder of the air-flow drying unit to have a drilled peripheral surface which can be exposed to suction. In this respect, the fibrous web is usually guided round the drying cylinder by an element of machine clothing, where on the paper side of the element of machine clothing an under-pressure generated through the drilled peripheral surface of the drying cylinder exposed to suction.

Preferably, the air flow in the air-flow drying unit is produced by a hood extending over at least sections of that part of the periphery of the drying cylinder wrapped around by the fibrous web, with the fibrous web being led between the said hood and the drying cylinder.

A compromise between good drying capacity and acceptable strain level imposed on the fibrous web by the element of machine clothing taking it through the air-flow drying unit is attained if the heated air in the air-flow drying unit has a temperature of 150° C. or more, preferably of 180° C. or more and with a special preference for 220° C. or more.

To increase the dry-weight content in the pressing section and at the same time thereby to increase the runability of the whole machine it is logical if the single press-nip takes the form of a shoe press.

Particularly good dry-weight contents are achievable if the shoe press has a shoe length of 270 mm or more, preferably of 300 mm or more and with a special preference for 330 mm or more.

A symmetrical level of de-watering of the fibrous web is a prerequisite for a symmetrical development of the sheet properties and, thereby, for good performance properties in use such as printability, print quality and dimensional stability. To ensure symmetrical de-watering in the pressing section a further configuration of the invention provides that the fibrous web is led through the single press-nip in the form of a sandwich between an upper and a lower felt.

Preferably, the upper and/or the lower felt has a length of 20 meters or more, preferably of 30 meters or more. This increases the life of the felt, since for the same volume of output each area of a long felt will pass through the press-nip less frequently than would be the case for a shorter felt.

The de-watering in the pressing section comprising only a single press-nip is particularly effective if at least one of the felts used has sufficient capacity for taking up the expelled water. A further preferred embodiment of the invention therefore provides that the upper and/or the lower felt has a weight per unit area of 1200 g/m$^2$ or more, preferably of 1500 g/m$^2$ or more.

If both felts have the same weight per unit area this will promote symmetrical de-watering.

In order to ensure that following the de-watering of the fibrous web by a felt laden with liquid, that felt is again able to absorb water during its next passage through the press-nip, it is necessary for the felt to be de-watered in between. A particularly good level of de-watering of the felt is observed if two, three or more suction devices are provided to act upon each felt.

To achieve symmetrical sheet formation in the forming section it is logical if the formed fibrous web is symmetrically de-watered in the forming section. Consequently, a preferred development of the invention provides that the machine for producing a fibrous web comprises a forming section with a gap former which preferably is essentially de-watered symmetrically.

A symmetrical de-watering of the fibrous web is a prerequisite for a symmetrical development of sheet properties and, consequently, for good performance properties in use such as printability, print quality and dimensional stability. The best properties are obtained if the fibrous web is symmetrically processed in each of all the main sections, i.e. in the forming section, the pressing section and the drying section.

To prevent web breaks and thereby to improve runability a further particularly preferred embodiment of the invention provides that the fibrous web is led from the forming section to the end of the second drying group of the drying section without the use of a free draw.

The single nip-press makes it necessary to monitor the condition of the felt and of the web as precisely as possible. Therefore, all the volumes of water from, for example, the discharge channels, troughs are measured and recorded as a function of place and time. In a similar manner, the condition of the felt and of the web is measured by continuously traversing sensors and recorded. This is a prerequisite for the optimization of the life of the felt and the operation of the machine.

Furthermore, the invention relates to a process for producing a fibrous web in which a fibrous web is pressed only once and is treated in the drying section. with a flow of air.

Preferably, the process according to the invention is used to produce fibrous webs with a weight per unit area in the range between 35 g/m$^2$ and 120 g/m$^2$ and a filler material content of between 10% and 40% and for production at a web running speed of up to 2400 m/min and more. Preferably, in this respect the above-described machine is employed.

Special preference is given to the process according to the invention used for the production of fibrous webs with a weight per unit area of between 35 g/m$^2$ and 50 g/m$^2$ and a filler material content of between 10% and 25%, preferably between 15% and 18% at a web running speed of 1600 m/min or more, preferably 2200 m/min or more and with a special preference for 2400 m/min or more.

Alternatively, preference is given to the process according to the invention used for the production of fibrous webs with a weight per unit area of between 50 g/m$^2$ and 60 g/m$^2$ and a filler material content of between 20% and 40%, preferably between 25% and 40% at a web running speed of 1600 m/min or more, preferably 2000 m/min or more and with a special preference for 2200 m/min or more.

Alternatively, preference is given to the process according to the invention used for the production of fibrous webs with a weight per unit area of between 60 g/m$^2$ and 120 g/m$^2$ and a filler material content of between 15% and 25%, preferably between 18% and 25% at a web running speed of 1500 m/min or more, preferably 1900 m/min or more and with a special preference for 2100 m/min or more.

BRIEF DESCRIPTION OF THE DRAWINGS

The invention is described in more detail below by reference to a preferred exemplary embodiment with the aid of a drawing, in which.

DETAILED DESCRIPTION

Figure 1:
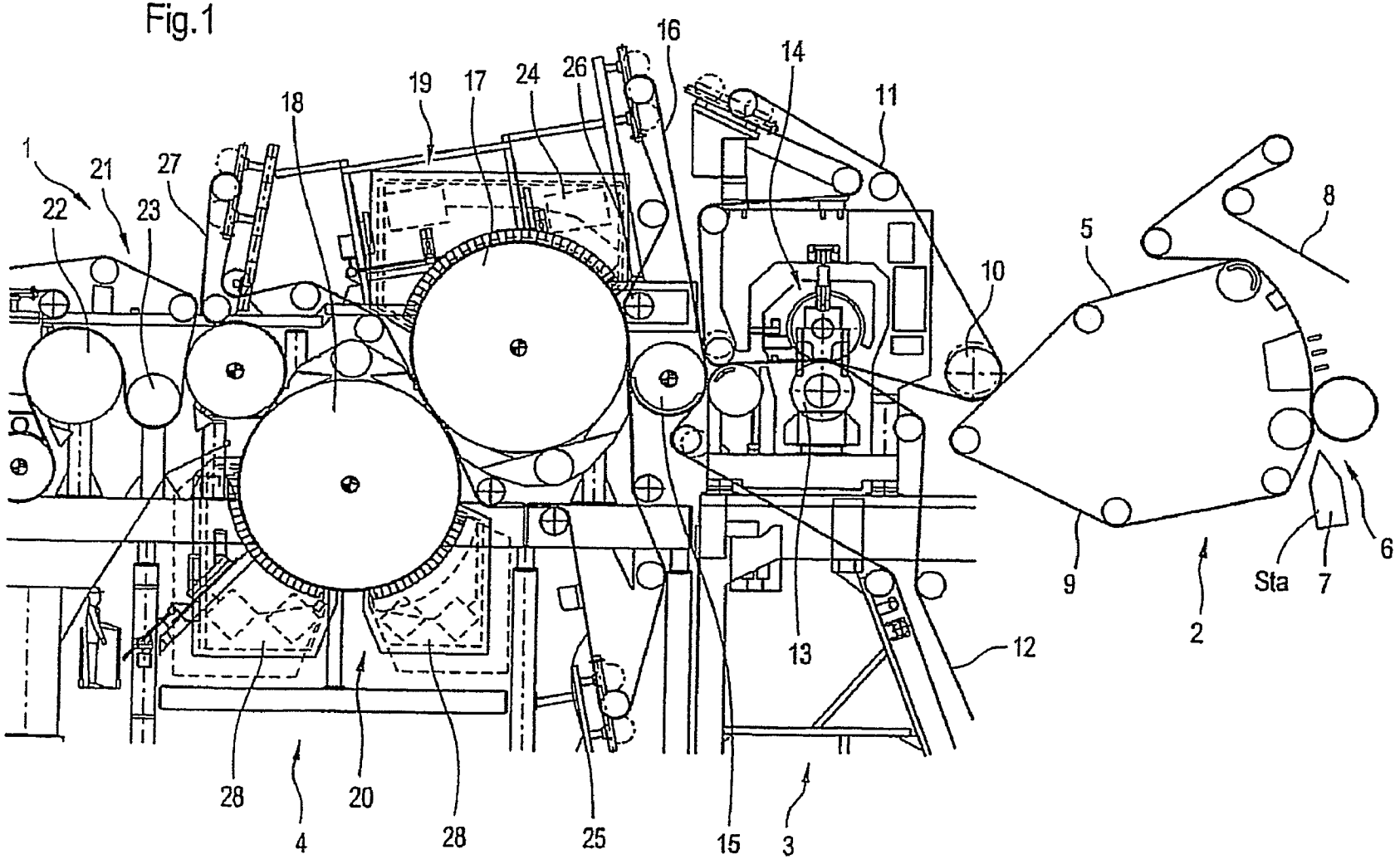
FIG. 1 shows a section in a side view of a machine according to the invention for producing a fibrous web.

The illustrated embodiment of a machine 1 according to the invention for producing a fibrous web has a forming section 2, a pressing section 3 and a drying section 4.

In the forming section 2 a fibrous web 5 is introduced in a gap former 6 through a material inlet 7 into a gap formed between an upper fabric 8 and a lower fabric 9 and, for example, symmetrically de-watered to a dry-weight content of between 18%, 20% or more.

Then the fibrous web 5 is transferred by a pick-up roll 10 from the lower fabric 9 to an upper press felt 11 of the pressing section 3. The fibrous web 5 is not exposed to a free draw in the course of the transfer between the forming section 2 and the pressing section 3 because it is continuously supported by an element of machine clothing 9, 11. In the pressing section 3 the fibrous web 5 is led in the form of a sandwich between the upper press felt 11 and a lower press felt 12 through only one press-nip 13 formed by a shoe press 14 and thereby de-watered symmetrically.

The upper felt 11 and the lower felt 12 have a weight per unit area of 1200 g/m$^2$ or more, preferably 1500 g/m$^2$ or more. In this way, the de-watering of the fibrous web in the pressing section 3 comprising only a single press-nip 13 is particularly effective, as the felts 11, 12 used have an adequate capacity to take up the expelled water.

The shoe press 14 forms in this case a press-nip 13 with a length of 270 mm or more, preferably 300 mm or more and with a special preference for 330 mm or more.

At the end of the pressing section 3 the fibrous web 5 is transferred by a pick-up roll 15 from the lower felt 12 to a transfer belt 16.

The drying section 4 has two consecutively arranged air-flow drying units 19 and 20 as first and second drying groups together with a conventional drying device 21 with heated drying cylinders 22 and 23 as third drying group, which are however portrayed in FIG. 1 only partially.

Essentially, the air-flow drying unit 19 is formed by a drying cylinder 17, a hood 24 and a dryer fabric 25.

The fibrous web 5 is led in the air-flow drying unit 19 up to a roll 26 in the form of a sandwich between the transfer belt 16 and the dryer fabric 25. After that, the fibrous web with one side lying on the dryer fabric 25 and the other side free is led between the drying cylinder 17 and the hood 24, extending over at least sections of that part of the periphery of the drying cylinder 17 wrapped around by the fibrous web 5. The air flow of the air-flow drying unit 19 is produced by the hood 24.

The air-flow drying unit 19 operates according to the principle of impact-flow drying also known as impingement-drying.

Since the fibrous web 5 is not covered with an element of machine clothing on the side facing the flow of air, the drying capacity in the air-flow drying unit 19 is increased, because the fibrous web 5 to be dried is directly exposed to the flowing air.

To improve the guidance of the fibrous web 5 the drying cylinder 17 of the air-flow drying unit 19 has a drilled peripheral surface. Low pressure is maintained within the drying cylinder 17 which results in the fibrous web being sucked against the drying cylinder 17 the air-permeable dryer fabric 25 in the wrapped around area. The drying cylinder 17 has a diameter of 4 meters.

After passing through the air-flow drying unit 19 the fibrous web 5 is transferred to the air-flow drying unit 20 which essentially comprises a drying cylinder 18, two hoods 28 and a dryer fabric 27.

In an analogous manner to that of air-flow drying unit 19 the fibrous web 5 is led through the air-flow drying unit 20, with the difference that it is now the side of the fibrous web 5 which faced the dryer fabric 25 in the air-flow drying unit 19 and was not, therefore, then exposed to the flow of air which is now exposed to that flow of air in the air-flow drying unit 20. This means that the fibrous web 5 is treated in a symmetrical manner.

Consequently, the fibrous web 5 is treated symmetrically in each of all the main sections, i.e. in the forming section 2, the pressing section 3 and the drying section 4, which is a prerequisite for a symmetrical development of the sheet properties and, consequently, for good performance properties in use such as printability, print quality and dimensional stability.

In both air-flow drying units 19 and 20 the temperature of the air flowing against the fibrous web is 150° C. or more, preferably 180° C. or more and with a special preference for 220° C. or more.

Preferably, the machine 1 according to the invention for producing a fibrous web is used in processes for producing a fibrous web with a weight per unit area of between 35 g/m$^2$ and 50 g/m$^2$ and a filler material content of between 10% and 20%, preferably between 15% and 18%, where the fibrous web is produced at a web running speed of 1600 m/min or more, preferably 2200 m/min or more and with a special preference for 2400 m/min or more.

Alternatively, the machine 1 according to the invention is used in the process for producing a fibrous web with a weight per unit area of between 50 g/m$^2$ and 60 g/m$^2$ and a filler material content of between 20% and 40%, preferably between 25% and 40%, where the fibrous web is produced at a web running speed of 1600 m/min or more, preferably 2000 m/min or more and with a special preference for 2200 m/min or more.

Alternatively, the machine 1 according to the invention is used in the process for producing a fibrous web with a weight per unit area of between 60 g/m$^2$ and 120 g/m$^2$ and a filler material content of between 15% and 25%, preferably between 18% and 25%, where the fibrous web is produced at a web running speed of 1500 m/min or more, preferably 1900 m/min or more and with a special preference for 2100 m/min or more.

The invention claimed is:

1. A machine for the production and/or further processing of a fibrous web with a press section and a drying section, wherein the press section comprises solely one single press-nip, the fibrous web being led through the single press-nip in the form of a sandwich between an upper and a lower felt, and wherein the drying section comprises at least two air-flow drying units arranged so that in one of the at least two air-flow drying units one side of the fibrous web faces a flow of air and in the other of the at least two air-flow drying units the other side of the fibrous web faces a flow of air, wherein the fibrous web is led from the forming section to the end of a second drying group of the drying section without the use of a free draw, and wherein the fibrous web is transferred from the lower felt of the press nip to a transfer belt which does not run through a drying unit, and from the transfer belt to a dryer fabric of the drying section.

2. The machine as claimed in claim 1, characterized in that at least one air-flow drying unit operates according to the principle of through-flow air drying/TAD-drying.

3. The machine as claimed in claim 1, characterized in that at least one air-flow drying unit operates according to the principle of impact-flow drying/impingement-drying,

4. The machine as claimed in claim 1, characterized in that the fibrous web is not covered with an element of machine clothing on the side facing the flow of air.

5. The machine as claimed in claim 1, characterized in that at least one air-flow drying unit has a drying cylinder with a diameter of 3 meters or more.

6. The machine as claimed in claim 1, characterized in that a drying cylinder of the air-flow drying unit has a drilled peripheral surface and can be exposed to suction.

7. The machine as claimed in claim 1, characterized in that at least one air-flow drying unit comprises a drying cylinder and at least one hood extending over at least sections of the periphery of the drying cylinder and which produces a flow of air, with the fibrous web being led between the said hood and the drying cylinder.

8. The machine as claimed in claim 1, characterized in that the machine comprises several pairs of air-flow drying units, where in each case in the first air-flow drying unit of the pair one side of the fibrous web faces the flow of air and where in each case in the following second air-flow drying unit of the pair the other side of the fibrous web faces the flow of air.

9. The machine as claimed in claim 1, characterized in that the heated air in the air-flow drying unit has a temperature of 150° C. or more.

10. The machine as claimed in claim 1, characterized in that the single press-nip takes the form of a shoe press.

11. The machine as claimed in claim 1, characterized in that the shoe press has a shoe length of 270 mm or more.

12. The machine as claimed in claim 1, characterized in that the upper and/or the lower felt has a length of 20 meters or more.

13. The machine as claimed in claim 1, characterized in that the upper and/or the lower felt has a weight per unit area of 1200 g/m$^2$ or more.

14. The machine as claimed in claim 1, characterized in that two, three or more suction devices are provided to act upon each felt.

15. The machine as claimed in claim 1, characterized in that the machine comprises a forming section with a gap former.

16. The machine as claimed in claim 1, characterized in that at least one air-flow drying unit has a drying cylinder with a diameter of 4 meters or more.

17. The machine as claimed in claim 1, characterized in that the heated air in the air-flow drying unit has a temperature of 180° C. or more.

18. The machine as claimed in claim 1, characterized in that the heated air in the air-flow drying unit has a temperature of 220° C. or more.

19. The machine as claimed in claim 1, characterized in that the shoe press has a shoe length of 300 mm or more.

20. The machine as claimed in claim 1, characterized in that the shoe press has a shoe length of 330 mm or more.

21. The machine as claimed in claim 1, characterized in that the upper and/or the lower felt has a length of 30 meters or more.

22. The machine as claimed in claim 1, characterized in that the upper and/or the lower felt has a weight per unit area of 1500 g/m$^2$ or more.

* * * * *